United States Patent [19]

Millard

[11] 4,180,932

[45] Jan. 1, 1980

[54] ANIMATED PLANT DISPLAY

[76] Inventor: Irving I. Millard, 46-27 157th St., Flushing, N.Y. 11355

[21] Appl. No.: 685,506

[22] Filed: May 12, 1976

[51] Int. Cl.[2] ..... A63H 13/20

[52] U.S. Cl. ..... 40/455; 40/411; 40/614; 46/124

[58] Field of Search ..... 40/139, 106.3, 106.33, 40/126 R, 126 B, 28.1, 33, 455, 430, 473, 614, 538, 540, 414, 411; 46/124, 118, 264

[56] References Cited

U.S. PATENT DOCUMENTS

| | | | |
|---|---|---|---|
| 122,875 | 1/1872 | Wiggers | 46/124 |
| 639,810 | 12/1899 | Grosjean | 40/106.3 |
| 1,579,613 | 4/1926 | Holmes | 40/106.33 X |
| 3,888,030 | 6/1975 | Bradt | 40/126 R |
| 3,975,845 | 8/1976 | Mellard | 40/106.3 |

*Primary Examiner*—John F. Pitrelli
*Attorney, Agent, or Firm*—Howard I. Podell

[57] ABSTRACT

A housing contains a rotating platform mounted on a shaft which is driven by a motor which can be operated by a battery, flowers plants and bells are mounted on the platform and a butterfly is mounted through a slot in a collar of the housing surrounding the platform, the wire supporting the butterfly is caused to vibrate by a cog wheel mounted on the shaft which causes cogs to press against the wire supporting the butterfly, another cog wheel mounted on the shaft causes a hammer mounted within the housing to gently hit a bell depending from a support within the housing, causing gentle bell like sounds while the butterfly moves around undulatingly as the platform rotates.

6 Claims, 8 Drawing Figures

ANIMATED PLANT DISPLAY

I have invented a new and novel animated plant display. My plant display produces soft soothing tinkling sounds as it rotates and graceful undulating motions of butterflies swooping in at the flowers in the display. While bells are mounted on the rotating platform containing the plants and flowers the sounds of the bells are produced by a bell and hammer mounted underneath the rotating platform while the motions of the butterfly simulate the stimulation of the bells mounted on the platform. The butterflies themselves are constructed uniquely and are mounted in a unique way in the housing of the display.

This invention discloses an improved means of producing bell like sounds and an improved means of animating a flying animal such as a butterfly. These animations are incorporated in a rotating display which may include plants, flowers, and bells.

My invention can be understood in view of the accompanying figures.

Figures 1, 2, 3, 4, 5, 6, 7, 8:
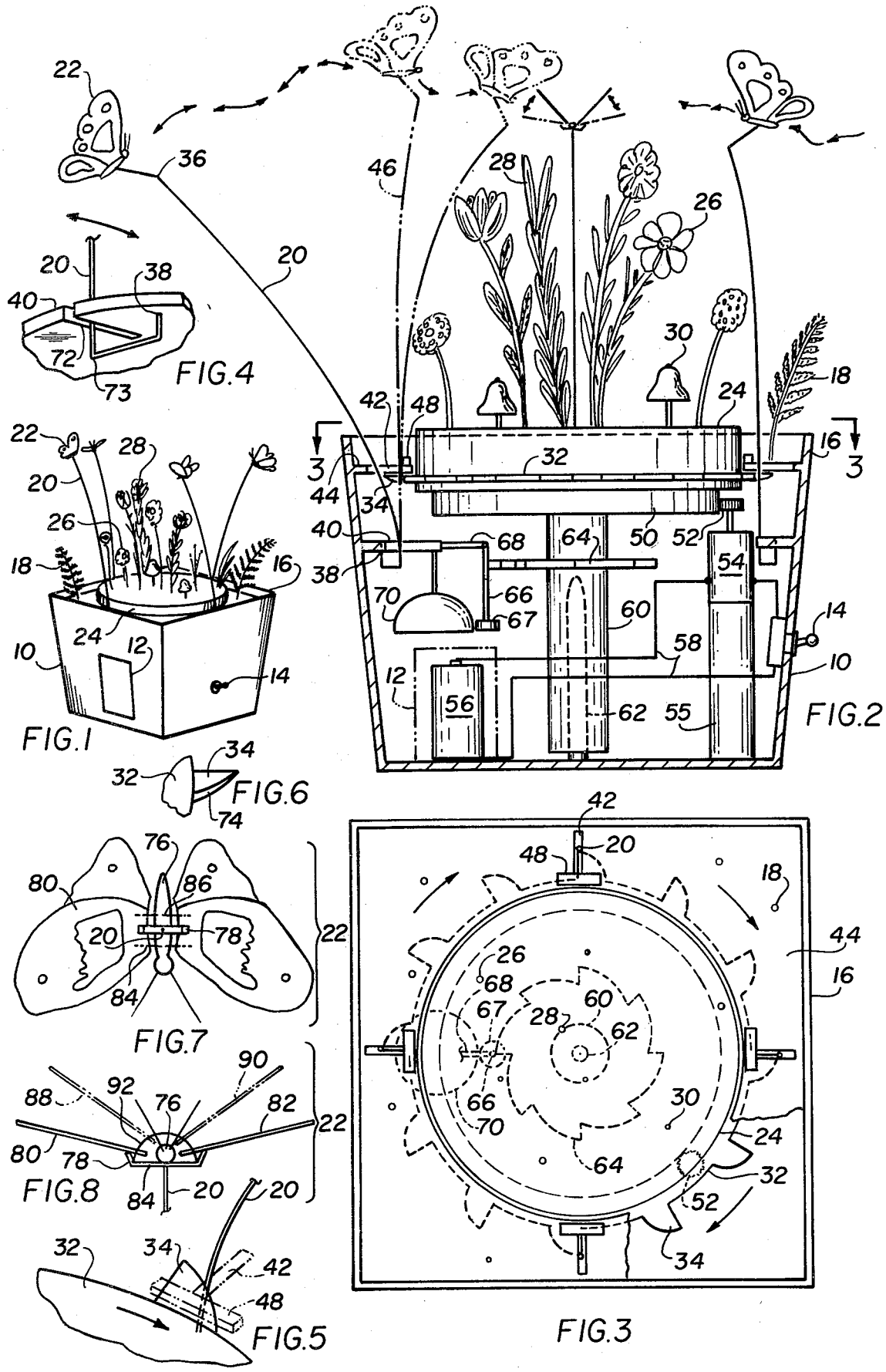
FIG. 1 shows a perspective view of this device.
FIG. 2 is a cross sectional view of the device.
FIG. 3 is a section of the device disclosed in FIG. 2 taken along the plane 3—3.
FIG. 4 is a detail of the attachment of the butterfly.
FIG. 5 is a detail of the cog wheel animating the butterfly support member.
FIG. 6 is a detail of the bevelled cog attached to the cog wheel.
FIG. 7 is a bottom view of the butterfly.
FIG. 8 is a front view of the butterfly.

With regard to FIGS. 1, 2, and 3, a housing 10 contains a door 12 for inserting and removing a battery. An activating switch 14 mounted on the housing can be used to start and stop the animation. Mounted within an upper rim 16 of the housing 10 are fern plants 18 in this embodiment. Wires 20 can be seen supporting butterflies 22 around a platform 24 which may be rotated and on which are seen flowers 26 and plants 28 and bells 30. A cog wheel 32 mounted along the lower part of the platform 24 has a plurality of cogs 34 extending from the cog wheel 32 and gently pressing the wire 20 which supports the butterfly 22. The wire is seen to form a slight bend 36 in order to enhance the undulating movement of the butterfly 22 when the cog releases the wire 20 and the wire can swing freely on its attachment 38 to a support 40 underneath the platform 24. The wire 20 travels in a slot 42 in a collar 44 above the cog wheel 32. After the wire 20 is pushed distally by the cog 34 it may rebound centrally 46 until it is stopped by a resilient stop piece 48 which impact causes the butterfly to undergo vibrating undulations. A frictional band 50 mounted under the platform 24 and preferably made of rubber is driven by a gear 52 which is activated by a motor 54 which is mounted in the housing 10. The motor 54 is electrically connected to a battery 56 mounted within the door 12 and electrically connected 58 to the activating switch 14 in order to complete the electrical circuit which will activate the motor 54. The platform 24 and frictional disk 50 are both concentrically mounted on a shaft 60 which rotates on a bearing 62 mounted to the base of the housing. Another cog wheel 64 mounted on the shaft 60 pivots an arm 66 from which depends a hammer 67. The arm 66 is supported by a horizontal member 68 attached to the support 40 so that a bell 70 dependent from the support 40 may be gently hit by the hammer 67 as it freely swings on the horizontal support 68. The free swinging of the hammer gently hitting the bell produces a soft tinkling sound as arises from the depths of the housing 10.

With regard to FIG. 4, the butterfly supporting wire 20 is seen to pass through a slot 72 in the support 40 and to be anchored after two right angle bends 73 in the upwardly direction 38 into the support 40. The acute bend 36, as seen in FIG. 2, and the double right angle bends 74 provide for the distinctive and undulating movements produced by the action of the cog wheel 32 on the support wire 20.

With regard to FIG. 5, the cog wheel 32 is seen to have cogs 34 which are convex on the leading edge and perpendicular to the cog wheel 32 on the trailing edge. In this view the cog 34 is distally displacing the wire 20 within the slot 42 of the collar 44 and when the wire is released by the cog wheel it will rebound and will impact on the resilient stop 48.

With regard to FIG. 6, the cog wheel 32 is seen to have a plurality of cogs 34 extending distally from the cog wheel 32 in each of the cogs is seen to have a bevelled tapered leading edge 74 so that the wire 20 will rebound off a thin pointed edge 75 of the cog 34.

With regard to FIGS. 7 and 8, the butterfly generally referred to as 22 is seen to compose a body 76 attached to the support wire 20 and a lateral brace 78 extending from the thorax region of the body. A set of wings 80 and 82 are held together spaced from the body by a set of thin flexible untreated cotton threads 84 and 86 so that the wings can rest gently on the upright ends of the lateral support member 78 while at rest. When the butterfly is moved by the action of the cog and begins to undulate the wings can move into an upright position 88 and 90 constrained from leaving the body of the butterfly 76 by the strings, visible as 92 in FIG. 8. Cotton threads are not stiff and they will not break.

The vibrating wire 20 should be of 0.014 inch gauge to cause the butterflies to vibrate properly and to cause the wings to flap.

A wind up motor can be used instead of the battery.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is;

1. An animated animal, comprising:

a body attached to a wire, a lateral support attached across a portion of the body, a pair of wings each resting on an upwardly bent edge of the lateral support, a plurality of wires each attached at an end to one of the wings and at another end to the other wing, whereby the wings may flutter when moved without falling down, the wire supporting the animal forming a slight bend near an upper end of the wire, and two right angle bends near a lower end of the wire, a housing forming an internal support, the lower end of the wire upwardly inserted in the support in the housing, a slot formed in the support through which the wire passes, a shaft rotatably mounted in the housing, a cog wheel concentrically mounted on the shaft, a collar mounted near an upper end of the housing around the platform and forming a slot through which the wire passes, a stop attached to a proximal end of the slot in the collar, and a cog on the cog wheel resiliently displacing the wire as the cog passes the wire, thereby causing the animal to undulate.

2. The animated animal of claim 1, wherein the animal supporting wire is 0.014 inch gauge, whereby the animal may move properly and the wings may flutter.

3. The animated animal of claim 1, wherein the plurality of wires attached to the wings are made of an untreated cotton thread.

4. An animated display, comprising a housing, a rotatable shaft mounted in the housing, means for rotating the shaft mounted in the housing, a sound producing means mounted in the housing comprising a bell, and activated by the rotation of the shaft, an ornamented platform fixedly attached to an upper end of the shaft and visible exteriorly at an upper end of the housing, an animal figure attached by a wire to an interior portion of the housing.

means for activating the animal by pressably contacting said wire attached to the shaft, and a means of activating the bell, said bell being suspended from a support attached to an interior support in the housing, an arm extending centrally from the support, an arm freely dependently pivoting from a central end of the arm, a hammer attached to a distal end of the rod and resting just adjacent to an outside surface of the bell when at rest, and a cog wheel attached concentrically around the shaft and pressably contacting the rod when the shaft is rotated, thereby displacing the rod and causing the hammer to swing and gently hit the bell, thereby producing bell sounds.

5. An animated display, comprising:

a housing, a rotatable shaft mounted in the housing, means for rotating the shaft mounted in the housing, a sound producing means mounted in the housing and activated by the rotation of the shaft, an ornamented platform fixedly attached to an upper end of the shaft and visible exteriorly at an upper end of the housing, an animal figure attached by a wire to an interior portion of the housing, a means for activating the animal by pressably contacting said wire attached to the shaft, the wire supporting the animal forming a slight bend near an upper end of the wire, and two right angle bends near a lower end of the wire, the lower end of the wire upwardly inserted in a support in the housing, a slot formed in the support through which the wire passes, a cog wheel concentrically mounted on the shaft, a collar mounted near an upper end of the housing around the platform and forming a slot through which the wire passes, a stop attached to a proximal end of the slot in the collar, and a cog on the cog wheel resiliently displacing the wire as the cog passes the wire, thereby causing the animal to undulate.

6. The animated display of claim 5, wherein the cog has a convex tapered leading edge and a trailing edge perpendicular to the cog wheel forming a point at the distal end of the cog.

* * * * *